US008550550B2

(12) United States Patent
Cassese et al.

(10) Patent No.: US 8,550,550 B2
(45) Date of Patent: Oct. 8, 2013

(54) SEAT ARM CUP HOLDER FOR SNACK FOODS

(76) Inventors: Joseph D. Cassese, Upper Saddle River, NJ (US); James Hicswa, Saddle Brook, NJ (US)

( * ) Notice: Subject to any disclaimer, the term of this patent is extended or adjusted under 35 U.S.C. 154(b) by 0 days.

(21) Appl. No.: 12/831,006

(22) Filed: Jul. 6, 2010

(65) Prior Publication Data

US 2010/0314387 A1 Dec. 16, 2010

Related U.S. Application Data

(63) Continuation of application No. 11/853,370, filed on Sep. 11, 2007, now Pat. No. 7,748,536, which is a continuation-in-part of application No. 11/187,287, filed on Jul. 22, 2005, now abandoned.

(60) Provisional application No. 60/591,247, filed on Jul. 26, 2004, provisional application No. 60/602,923, filed on Aug. 19, 2004, provisional application No. 60/665,284, filed on Mar. 25, 2005.

(51) Int. Cl.

| | |
|---|---|
| ***A47C 7/62*** | (2006.01) |
| ***A47C 7/68*** | (2006.01) |
| ***A47K 1/08*** | (2006.01) |
| ***B65D 1/36*** | (2006.01) |

(52) U.S. Cl.

USPC ..... 297/188.18; 220/23.8; 248/311.2

(58) Field of Classification Search

USPC ..... 206/219, 223, 542, 557–565; 219/725–735; 426/107–115, 119–120, 426/122, 234; 229/400; 108/25, 26; 297/188.14, 188.18, 194; 248/311.2; D7/553.4, 553.6, 553.3; 220/23.2–23.8

See application file for complete search history.

(56) References Cited

U.S. PATENT DOCUMENTS

| | | | |
|---|---|---|---|
| 421,264 | A | 2/1890 | Gibbons |
| 1,665,289 | A | 4/1928 | Weaver |
| 1,881,416 | A | 10/1932 | Uhalt |
| 2,036,687 | A | 4/1936 | Fisher |
| 2,301,216 | A | 11/1942 | Koontz |
| 2,858,970 | A | 12/1954 | Barnes et al. |
| 2,865,768 | A | 12/1954 | Barnes et al. |
| 3,148,636 | A | 9/1964 | Bloomquist et al. |
| 3,285,495 | A | 11/1966 | Colato |
| 3,288,344 | A | 11/1966 | Woollen et al. |
| 3,401,858 | A | 9/1968 | White et al. |
| 3,422,986 | A | 1/1969 | Tilseth |
| 3,873,738 | A | 3/1975 | Zoeller et al. |
| 4,038,425 | A | 7/1977 | Brandberg et al. |
| 4,219,144 | A | 8/1980 | Hagelberg |
| 4,461,396 | A | 7/1984 | Harper |
| 4,534,469 | A | 8/1985 | Elsmo |
| 4,607,758 | A | 8/1986 | Stevens |
| D285,999 | S | 10/1986 | Ludwick |
| 4,744,597 | A | 5/1988 | Bauman et al. |
| 4,779,998 | A | 10/1988 | Wischusen |

(Continued)

*Primary Examiner* — Byron Gehman

(74) *Attorney, Agent, or Firm* — Banner & Witcoff, Ltd.

(57) ABSTRACT

A snack holder includes a generally cylindrical cup sized and shaped lower section and a larger container or multiple container upper or adjacent section for holding snack foods or additional cups. The snack holder may be combined with a tray comprised of at least first and second cup shaped cylindrical sections joined by a web and compatibly sized to receive and support the snack holder as well as to fit into a cup holder in the arm rest of a seat.

5 Claims, 21 Drawing Sheets

(56) References Cited

U.S. PATENT DOCUMENTS

| | | | | |
|---|---|---|---|---|
| 4,836,970 | A | 6/1989 | Robbins | |
| 4,989,742 | A | 2/1991 | Powell | |
| 5,045,659 | A | 9/1991 | Wolfe et al. | |
| 5,092,457 | A * | 3/1992 | Islava et al. | 206/223 |
| 5,100,607 | A | 3/1992 | Robbins | |
| 5,111,960 | A | 5/1992 | Zilliox | |
| 5,118,063 | A * | 6/1992 | Young, Sr. | 248/311.2 |
| 5,180,079 | A | 1/1993 | Jeng | |
| 5,184,750 | A | 2/1993 | Moller | |
| 5,323,910 | A | 6/1994 | Van de Graaf, Jr. | |
| 5,390,798 | A | 2/1995 | Yanuzzi | |
| 5,425,455 | A | 6/1995 | Miller et al. | |
| 5,497,885 | A | 3/1996 | Sussman | |
| 5,542,577 | A | 8/1996 | Friedrich | |
| 5,573,131 | A | 11/1996 | Berjis | |
| 5,780,824 | A | 7/1998 | Matos | |
| D397,911 | S | 9/1998 | Waldmann | |
| 6,021,914 | A | 2/2000 | Schmidt | |
| 6,109,580 | A * | 8/2000 | Stern et al. | 248/311.2 |
| 6,149,027 | A | 11/2000 | Rathjen | |
| 6,182,890 | B1 | 2/2001 | Sattler et al. | |
| 6,320,172 | B1 | 11/2001 | Watkins | |
| 6,382,449 | B1 | 5/2002 | Kazmierski et al. | |
| 6,520,366 | B1 * | 2/2003 | Bradley et al. | 220/23.2 |
| 6,533,233 | B2 * | 3/2003 | Thomas | 248/311.2 |
| 6,586,715 | B2 | 7/2003 | Watkins | |
| 6,732,990 | B2 * | 5/2004 | Hudson | 248/311.2 |
| 7,243,991 | B2 * | 7/2007 | Ojeda | 297/188.14 |
| 7,748,536 | B2 | 7/2010 | Cassese et al. | |
| 2002/0145295 | A1 | 10/2002 | Frank et al. | |
| 2003/0218013 | A1 * | 11/2003 | Altman | 220/4.03 |

* cited by examiner 58
56
50
52
54
50

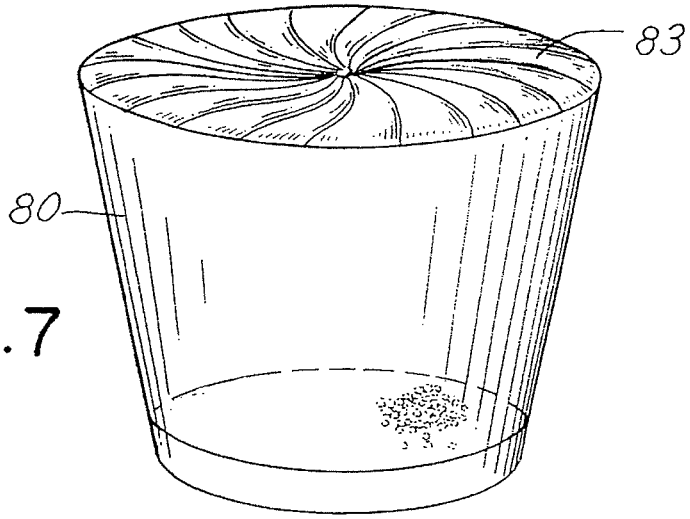
FIG. 7
FIG. 7A
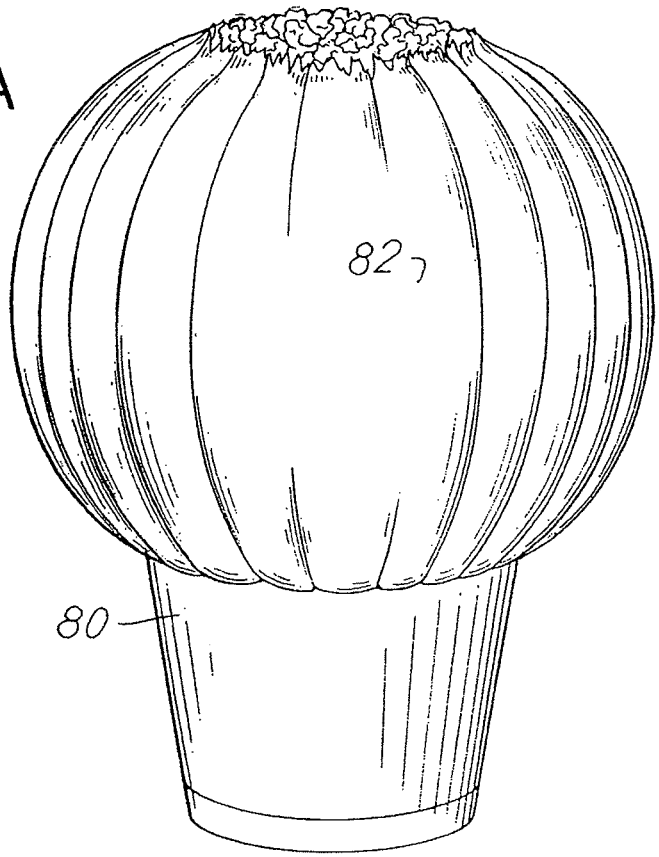

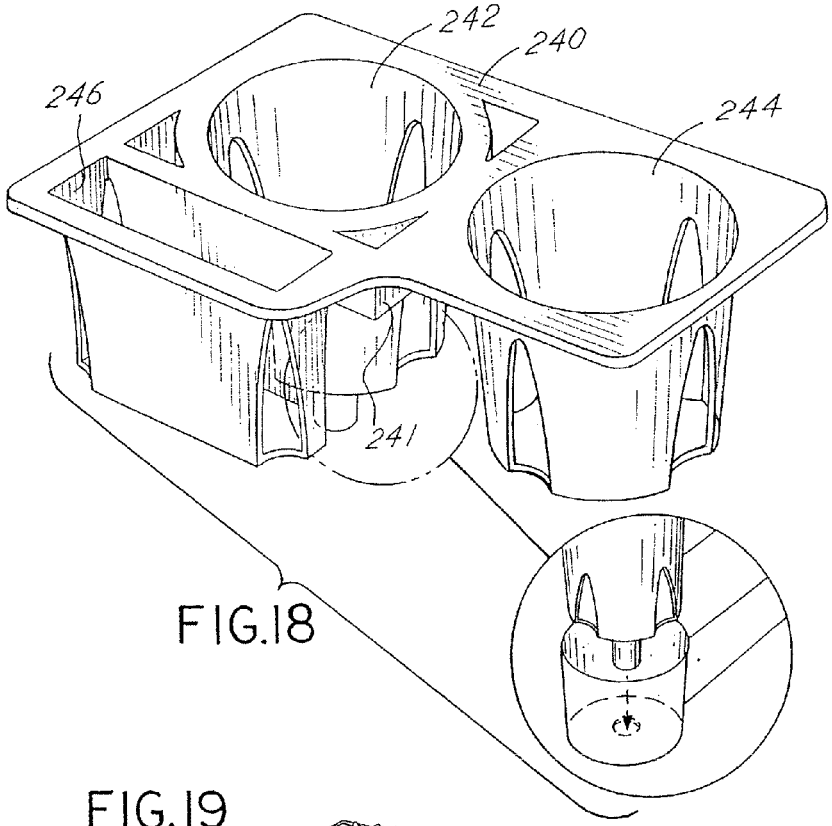
FIG.18
FIG.19
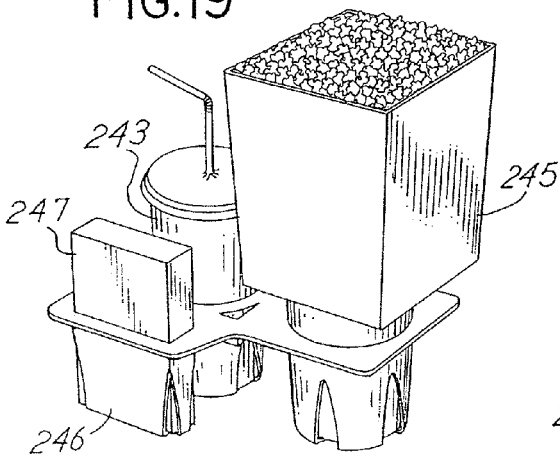
FIG.20
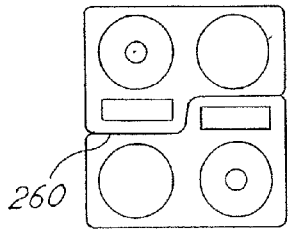

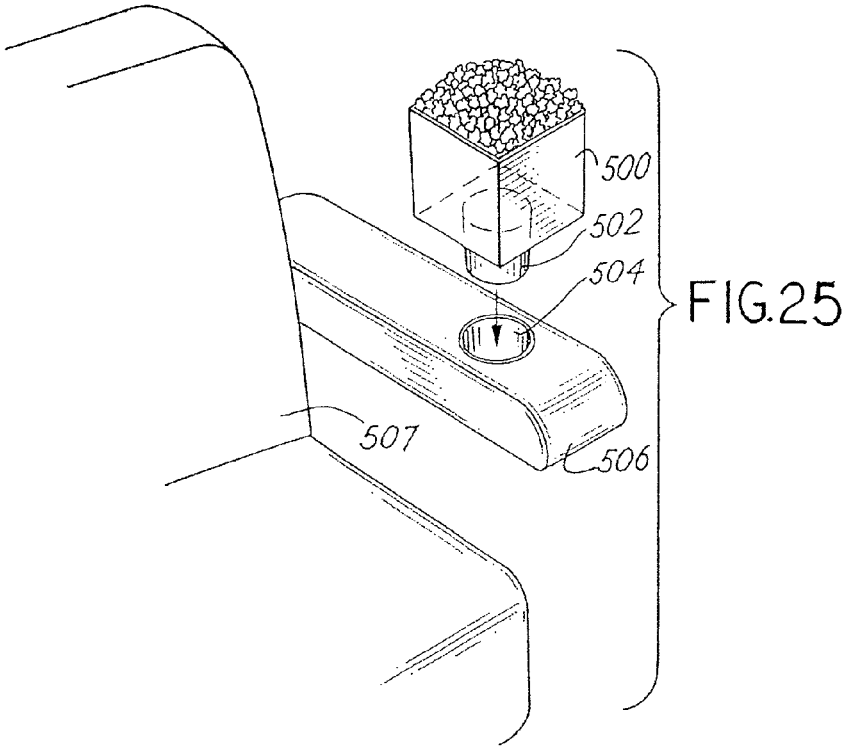
FIG.25
FIG.26
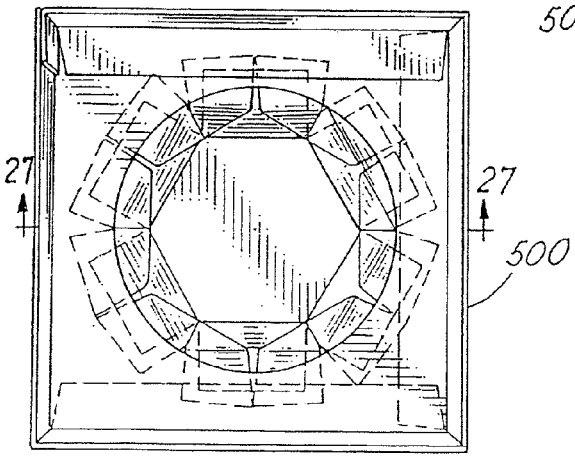
FIG.27
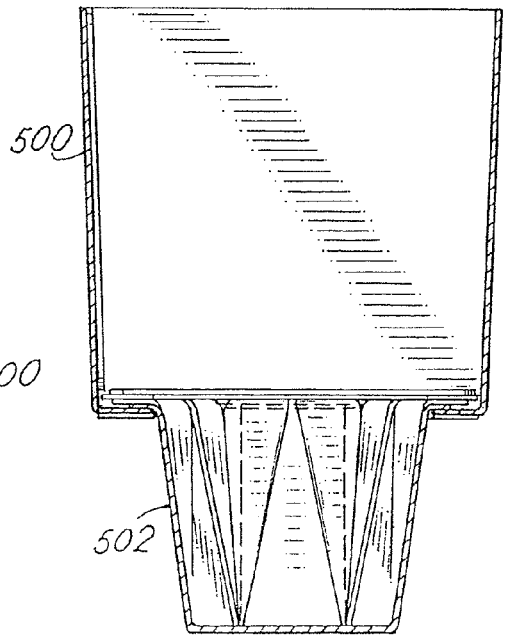

566
522
564
562
560

524
524

550
552
522
542
542
542

550
531

FIG.33
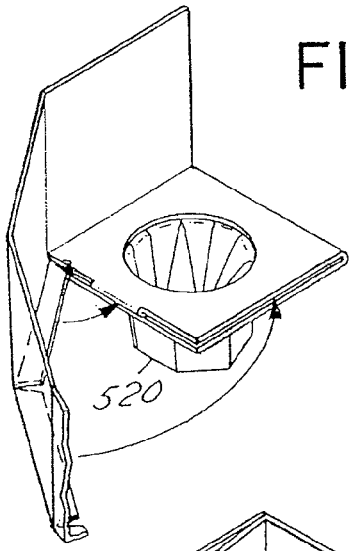
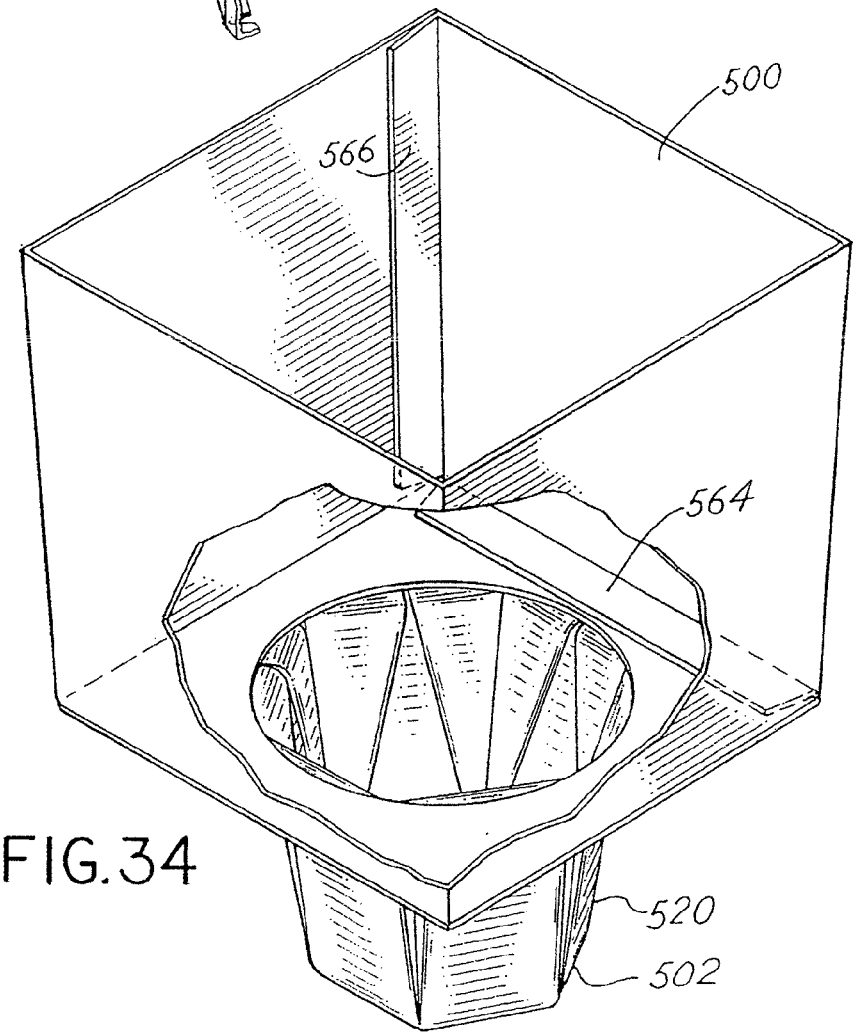
FIG.34

FIG.35
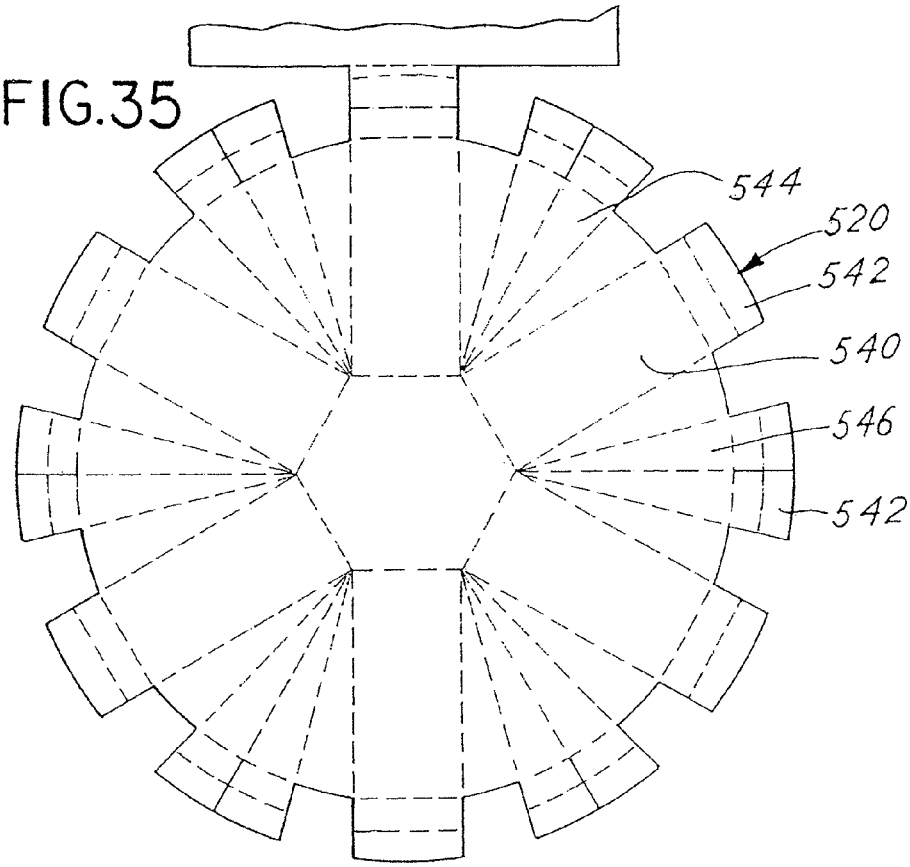
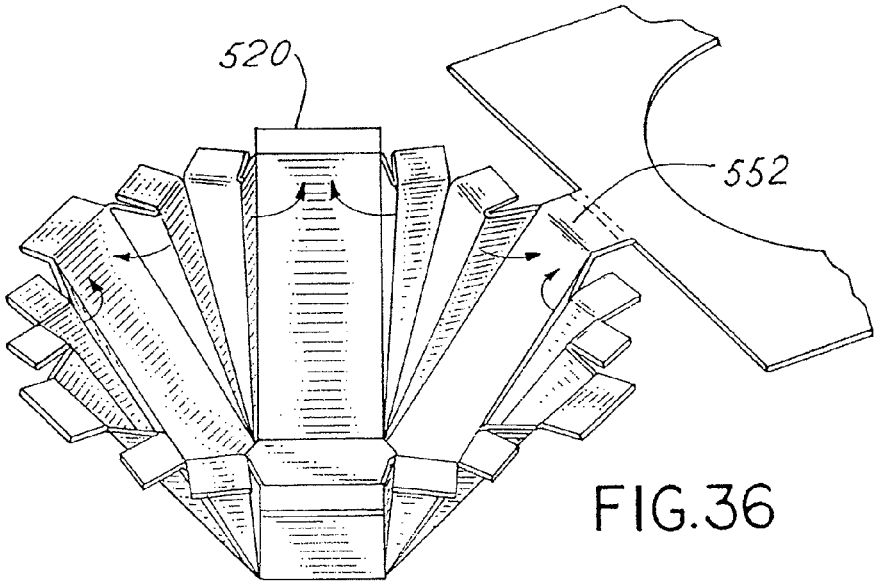
FIG.36

SEAT ARM CUP HOLDER FOR SNACK FOODS

CROSS REFERENCE TO RELATED APPLICATIONS

This is a continuation utility application based upon, incorporating by reference and claiming priority to the following utility application Ser. No. 11/853,370 (now U.S. Pat. No. 7,748,536) filed Sep. 11, 2007 (issued Jul. 6, 2010) entitled "Containers and Serving Trays for Snack Foods" and Ser. No. 11/187,287 (now abandoned) filed Jul. 22, 2005 entitled "Containers and Serving Trays for Snack Foods" and provisional applications: Ser. No. 60/591,247 filed Jul. 26, 2004 entitled "Container for Snack Foods"; Ser. No. 60/602,923 filed Aug. 19, 2004 entitled "Container for Snack Foods"; and Ser. No. 60/665,284 filed Mar. 25, 2005 entitled "Containers and Serving Trays for Snack Foods".

BACKGROUND OF THE INVENTION

In a principal aspect, the present invention relates to containers, cup holders and trays for snack foods which may be utilized by placement in a cup holder in a vehicle or in the arm of a theatre seat, for example.

When attending a movie theatre, entertainment venue or when driving a vehicle, snack food items are often purchased by the patron or driver or otherwise made available. Placement of these snack foods in a sack or box, or other similar container may be distracting and may also be inefficient or cumbersome. As a consequence, various product designs to accommodate such issues have been proposed. For example, combined food and beverage containers and trays have been proposed as illustrated or disclosed in the following listing of patents:

| Pat. No. | Inventor | Issue Date | Title |
|---|---|---|---|
| 1,665,289 | Weaver | Apr. 10, 1928 | Means for Serving Food and Drink |
| 3,285,495 | Colato | Nov. 15, 1966 | Reusable Food Package with Integral Adjustable Closure |
| 3,288,344 | Woollen et al. | Nov. 29, 1966 | Double Container Dispensing Package |
| Des. 285,999 | Ludwick | Oct. 07, 1986 | Combined Food and Beverage Container |
| 4,779,998 | Wischusen | Oct. 25, 1988 | Composite Bag-Like Package |
| 5,180,079 | Jeng | Jan. 19, 1993 | Combined Cup |
| 5,573,131 | Berjis | Nov. 12, 1996 | Apparatus for Forming a Container to Hold a Drinking Cup at the Bottom End of the Container and to Hold Food in the Upper Portion of the Container |
| Des. 397,911 | Waldmann | Sep. 08, 1998 | Combined Beverage and Snack Holder |
| 6,182,890 B1 | Sattler et al. | Feb. 06, 2001 | Collapsible Container for Holding Foodstuffs, and Methods of Using Same |

Such constructions typically call for the inclusion of a lower drink portion in the form of a cup and an upper snack food portion positioned over the lower portion. A straw typically provides access to the liquid lower portion. The upper portion typically includes an open top for manual access. Certain prior art patents suggest that a lower cup portion be shaped to fit into a cup holder.

Various other patents are directed to this general subject matter including the following:

| Pat. No. | Inventor | Issue Date | Title |
|---|---|---|---|
| Publication No. 2002/0145295 | Frank et al. | Oct. 10, 2002 | Bottomless Bag |
| 421,264 | Gibbons | Feb. 11, 1890 | Party Plate |
| 1,881,416 | Uhalt | Oct. 04, 1932 | Meal Serving Mat |
| 2,036,687 | C. Fisher | Apr. 07, 1936 | Moistureproof Bag |
| 2,301,216 | Koontz | Nov. 10, 1942 | Bottle Holder |
| 3,148,636 | Bloomquist et al. | Sep. 15, 1964 | Serving Tray |
| 3,401,858 | White et al. | Sep. 17, 1968 | Service Tray |
| 3,422,986 | Tilseth | Jan. 21, 1969 | Dish Lip Plate Attachment |
| 4,219,144 | Hagelberg | Aug. 26, 1980 | Serving Tray |
| 4,461,396 | Harper | Jul. 24, 1984 | Combined Plates and Glass Holders |
| 4,534,469 | Elsmo | Aug. 13, 1985 | Tray Assembly |
| 4,607,758 | Stevens | Aug. 26, 1986 | Serving Tray |
| 4,744,597 | Bauman et al. | May 17, 1988 | Food and Beverage Tray |
| 4,836,970 | Robbins | Jun. 06, 1989 | Method of Extrusion Blow-Molding Container Having Upper and Lower Sections of Different Thickness |
| 4,989,742 | Powell | Feb. 05, 1991 | Tray Apparatus |
| 5,100,607 | Robbins | Mar. 31, 1992 | Blow-Molding Methods to Form Containers Having Upper and Lower Sections of Different Thickness |
| 5,111,960 | Zilliox | May 12, 1992 | Interlocking Plate and Cup Set |
| 5,184,750 | Moller | Feb. 09, 1993 | Party Dish |
| 5,323,910 | van de Graaf, Jr. | Jun. 28, 1994 | Party Plate |
| 5,390,798 | Yanuzzi | Feb. 21, 1995 | Food and Beverage Support Tray with Beverage Vessel Cutout |
| 5,425,455 | Miller et al. | Jun. 20, 1995 | Folding Lap Tray |
| 5,497,885 | Sussman | Mar. 12, 1996 | Lap Tray for Carrying Food |
| 5,542,577 | Friedrich | Aug. 06, 1996 | Plate Assembly Gripping Member |
| 5,780,824 | Matos | Jul. 14, 1998 | Expandable and Self-Venting |

-continued

| Pat. No. | Inventor | Issue Date | Title |
|---|---|---|---|
| | | | Novelty Container for Cooking Microwave Popcorn |
| 6,021,914 | Schmidt | Feb. 08, 2000 | Hors D'oeuvre Tray |
| 6,149,027 | Rathjen | Nov. 21, 2000 | Combination Food Plate and Beverage-Container-Holder Article |
| 6,382,449 B1 | Kazmierski et al. | May 07, 2002 | Two Stage Cup |
| 6,586,715 B2 | Watkins | Jul. 01, 2003 | Microwavable Container for Food Products and Method of Fabricating Same |

Nonetheless, the availability of serving trays and cup holders for holding snack foods and/or retention thereof in a cup holder has been somewhat limited. The present invention is directed to various unique designs.

SUMMARY OF THE INVENTION

Briefly, the present invention comprises various designs for snack holders, cup containers and serving trays. In one embodiment a cup shaped container includes a bottom section or panel that is formed so as to be easily inserted and retained in a cup holder. The cup holder may, of course, be located in a theatre seat or other furniture or in a vehicle and typically comprises an opening for receipt of a circular cross section cup and optionally a support surface for supporting the bottom of the cup. Thus, the holder may comprise a circular opening only and support a cup by frictionally engaging the side of the cup.

Various alternative designs of snack container and serving tray devices, as well as methods for manufacture and assembly of such containers are disclosed. For example, a container may comprise a circular cross section lower cup shaped element connected to and supporting a generally larger, cone shaped or rectangular cross section upper element. The upper element may comprise a semi-rigid sided container or a bag. The container or bag may include a cover or top. Snack items may be pre-packaged in the container or added. The devices may be assembled from a folded flat configuration. Serving trays may incorporate a cup holder feature and multiple openings for holding snacks or containers of various sizes.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 7 is an isometric view illustrating a further embodiment of the invention especially useful for microwave popcorn as a snack food;

FIG. 7*a* is a further isometric view of the embodiment of FIG. 7;

FIG. 18 is an isometric view of a further embodiment of the invention including an exploded isometric view illustrating a feature of the invention for retaining the food tray or container in position in a cup holder;

FIG. 19 is an isometric view of the container or tray of FIG. 18 with snack food products placed therein;

FIG. 20 is a top plan view of the embodiment of FIG. 18 in combination with a second example thereof illustrating the manner in which the product may be manufactured;

FIG. 25 illustrates an isometric view of an additional embodiment of the invention;

FIG. 26 is a top plan view of the embodiment of FIG. 25;

FIG. 27 is a cross sectional view of the embodiment of FIG. 26 taken along the line 27-27;

FIG. 33 is an isometric view of yet another step in the folding of the pattern of FIG. 29;

FIG. 34 is a partially cut away view of the folded construct of FIG. 33;

FIG. 35 is an enlarged plan view of the pattern for the circular form for the cup of the pattern of FIG. 29; and FIG. 36 is an isometric view of the manner in which the pattern of FIG. 35 is folded.

DESCRIPTION OF THE PREFERRED EMBODIMENT

In general, the various types of snack food containers within the scope of the invention incorporate a bottom panel or lower side which is formed or shaped to fit into a cup holder, for example, at a theatre or entertainment venue. Multiple variations of this concept are disclosed. Variations contemplate, inter alia, forms of the lower base or cup portion of the product or device, methods for attaching or incorporating the cup shaped lower base to an upper container, variations of the form and shape of snack food container itself as used in combination with the lower cup shaped base, and use of a cup shaped base with a snack food package, such as a microwave popcorn package, wherein the microwave popcorn package contents may be subsequently processed. Consequently, there are many variations of the invention incorporating the general concept of a shaped base member capable of being inserted into a cup holder and a container portion associated with and mounted with or attached to the base member.

The upper container portion may have a generally flexible design fabricated from paper materials, for example. The upper container portion may also be of limited flexibility made, for example, from various grades of cardboard, plastic or other similar materials. The upper portion may be in the form of a bag or container which contains snack foods that are already packaged and maintained within secondary packaging in the container or covered by a removable cover sheet or replaceable top or cover to assure freshness. The upper container may be adapted to include food products or snacks which are not fully processed, for example, microwave popcorn products. In such an event, the upper container section may be sealed and may be folded in order to accommodate storage, packaging and transportation. Additionally, the entire assembly may be formed from plastic or other formable materials using molding techniques to form the container or package. The container may include instructions, advertising or other indicia. The interior of the containers may be appropriately coated to assure product freshness. Again, many combinations and permutations of the invention are disclosed.

Figure 1:
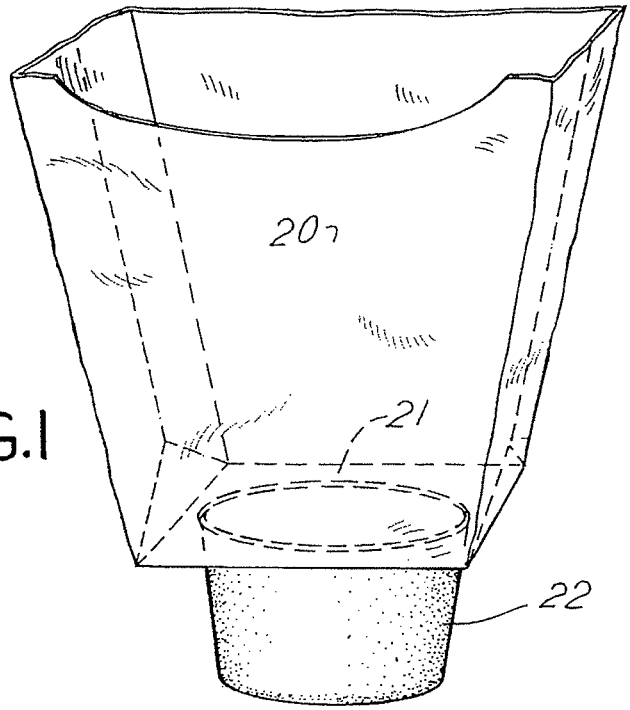
FIG. 1 is an isometric view of a first embodiment of the invention.

Referring to the figures therefore, FIG. 1 illustrates a flexible paper bag upper container 20 with a lower base 22 attached to a bottom panel 21 of the upper container 20. The lower base 22 may be in the form of a premolded plastic cup or a preformed paper cup, for example. Of course, the containers such as the top container 20 in FIG. 1 may be of a variety of materials, sizes and shapes. The lower base cup portion 22 is preferably a standard size which will fit within a cup holder.

Figure 2:
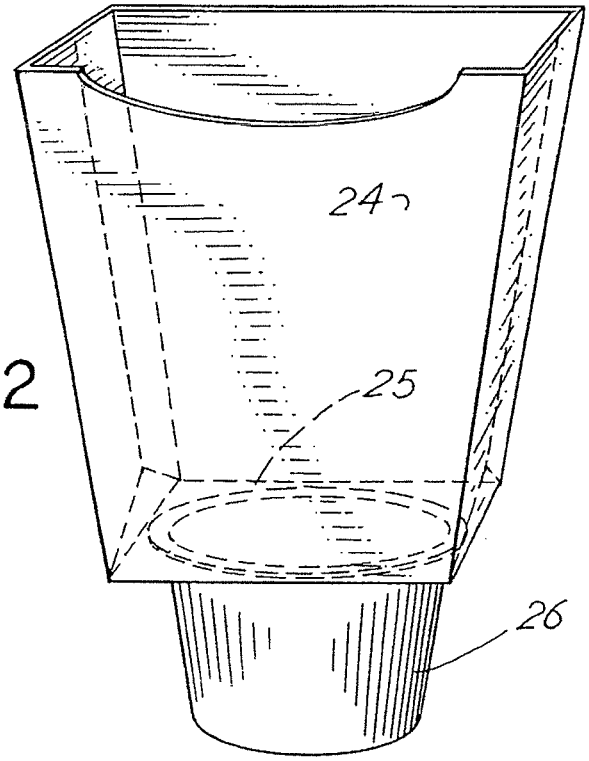
FIG. 2 is an isometric view of a second embodiment of the invention.

FIG. 2 illustrates an alternative embodiment wherein an upper container section 24 is made from a stiff cardboard construction, for example, and the lower base or cup portion 26 is fabricated from a treated paper material and is attached by an adhesive to the base 25 of section 24.

Figure 3:
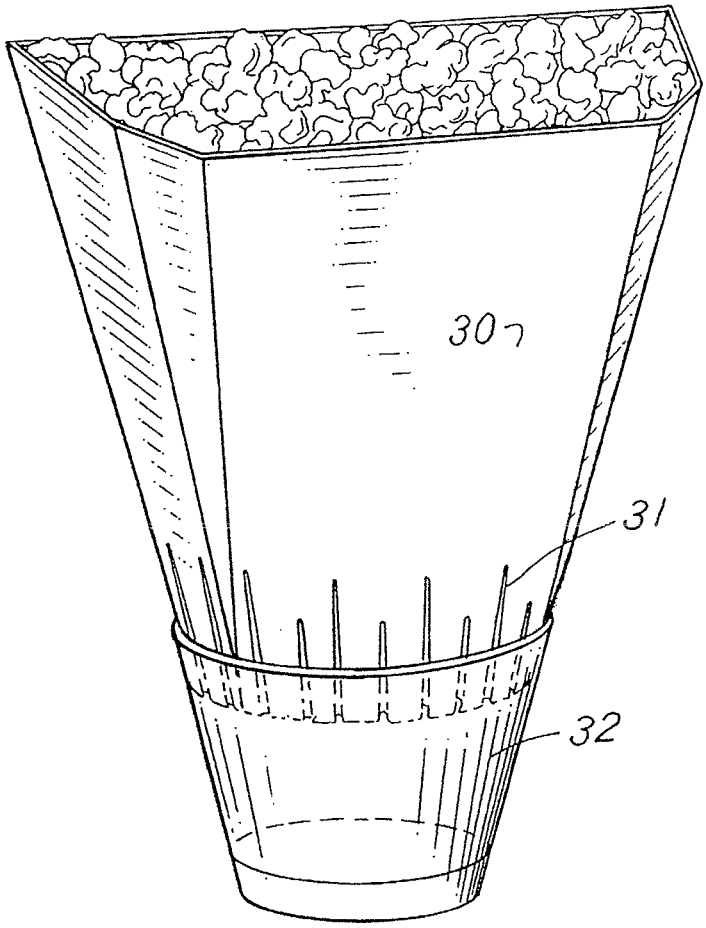
FIG. 3 is an isometric view of a third embodiment of the invention.

FIG. 3 illustrates the construction wherein an upper container 30 has a configuration which is generally truncated and designed to fit within a lower base or cup section 32. That is, the upper container includes multiple folds or crimped portions 31 and is fitted into and attached to the lower section 32. The upper section or container section 30 may be preassembled with the lower section 32 or unfolded from a flat storage condition and inserted into a lower section at a dispensing or point of sale station. The upper section may include printing or indicia on the outside surface. It may be coated with an interior wax layer to facilitate freshness and maintaining ingredients in the container.

Figure 4:
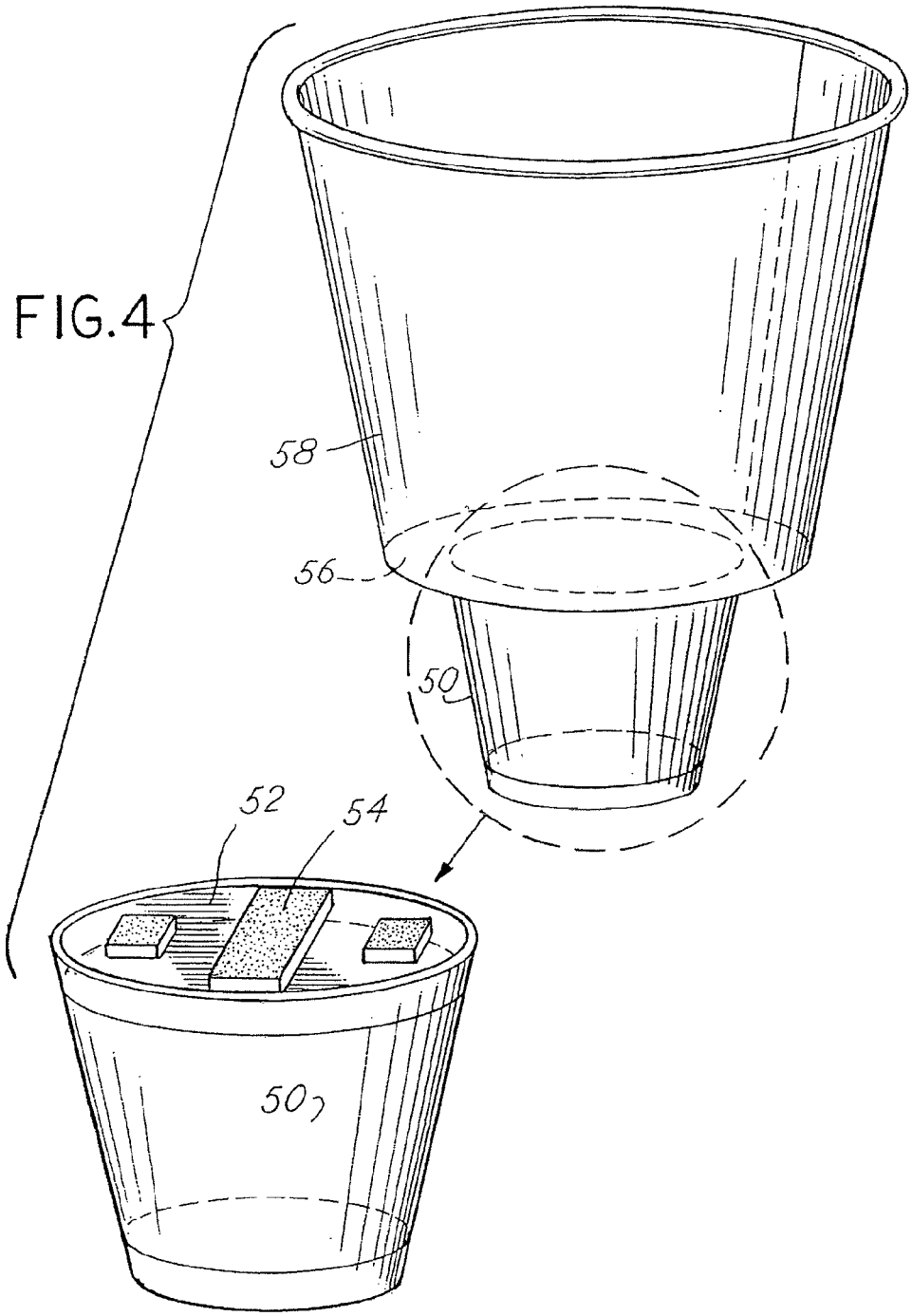
FIG. 4 is an isometric view of a fourth embodiment of the invention and further depicting a method of manufacture associated therewith.

FIG. 4 depicts yet another embodiment wherein a lower cup shaped base 50 includes a panel 52 with adhesive strips 54 or other attachment elements that attach to the lower base 56 of a tub type container 58. The cup base 50 has a configuration which will fit within a cup holder.

Figure 5:
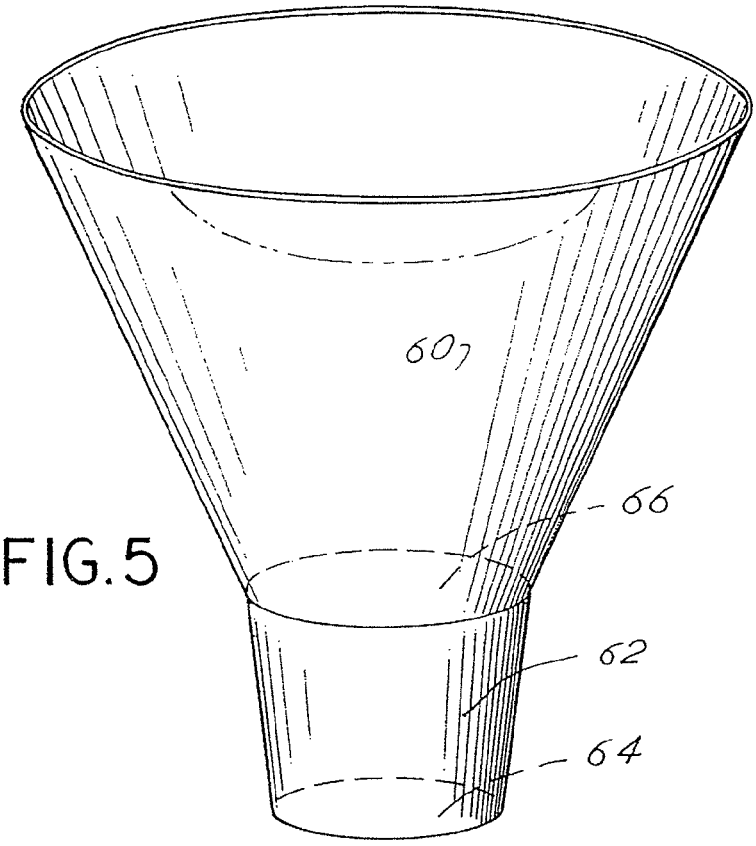
FIG. 5 is an isometric view depicting another version of the invention and a method of manufacture.
Figure 5A:
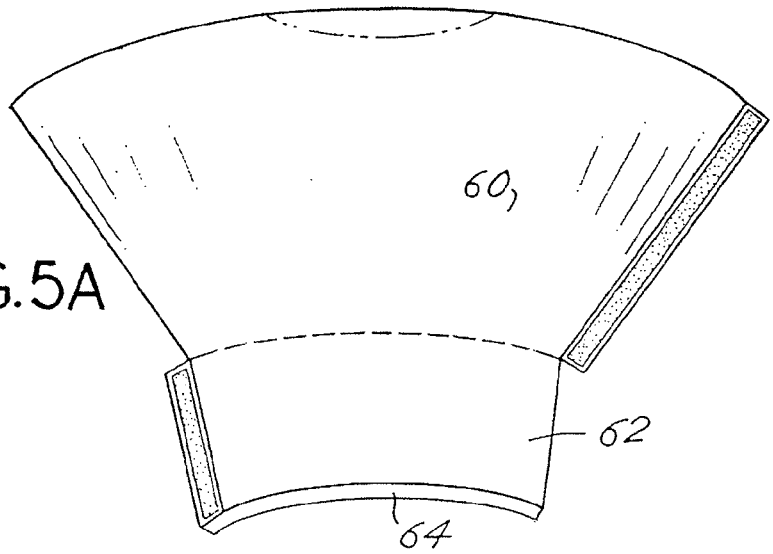
FIG. 5A is an isometric view depicting the embodiment of FIG. 5 in a folded condition.

FIG. 5 depicts a single piece design wherein a frustoconical upper container section 60 includes a lower base section 62 in the shape of a cup. The container may have a bottom panel 64. Alternatively, a bottom panel 66 may be provided or formed within the frustoconical cone section 60. The embodiment may be folded as depicted in FIG. 5A.

Figure 6:
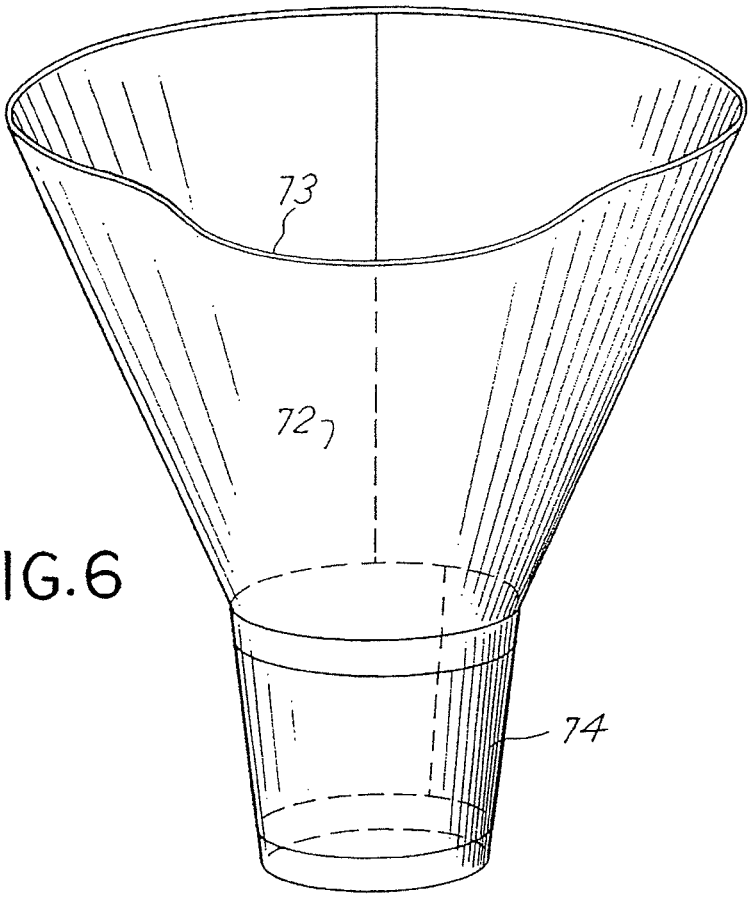
FIG. 6 is an isometric view depicting a further alternative embodiment of the invention and an associated method of manufacture.
Figure 6A:
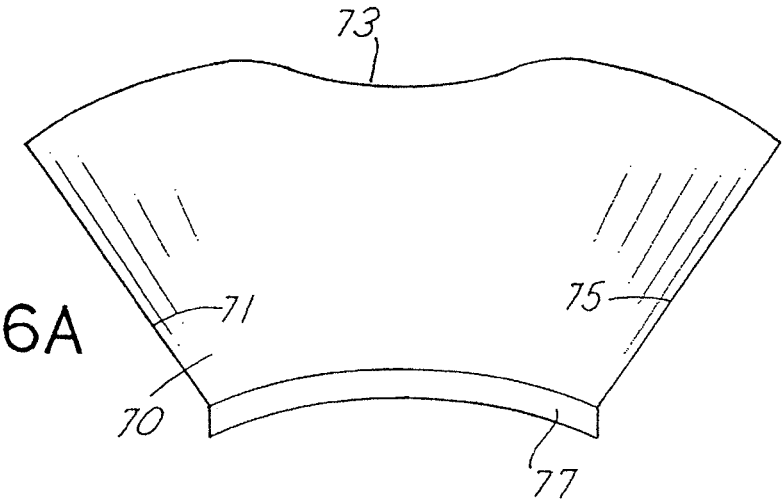
FIG. 6A is a plan view of a section of the embodiment of FIG. 6.

FIG. 6 illustrates a further embodiment wherein a section of planar cardboard or other material is cut and folded or formed as depicted in the figure to form a frustoconical container 72 which may be attached or inserted or coupled with a base section 74. An arcuate detent 73 facilitates access to the contents of container 72. FIG. 6A depicts the pattern for the container 72 which comprises an arcuate shape with sides 71, 75 that may be joined to form a seam. A lower margin is provided to affix to the top of cup 74.

FIGS. 7 and 7A illustrate a combination wherein a cup section 80 is sized to fit within a cup holder and includes an expandable and/or removable cover 83, so that microwave popcorn product, which upon placement in a microwave oven, will expand cover 83 to form an upper container 82 while the lower base cup shaped section 80 serves to hold the snack filled container 82 within a cup holder.

Figure 8:
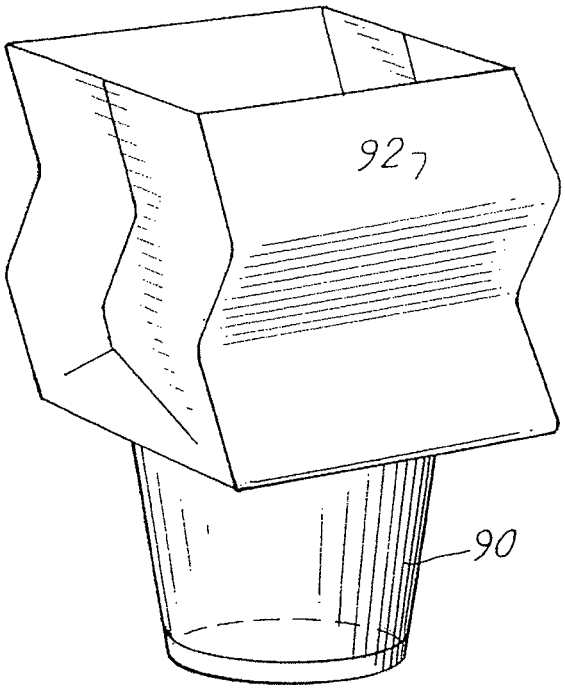
FIG. 8 illustrates a further embodiment of the invention wherein the snack food comprises microwave popcorn illustrating the manner of application of the invention to a fully popped snack.
Figure 9:
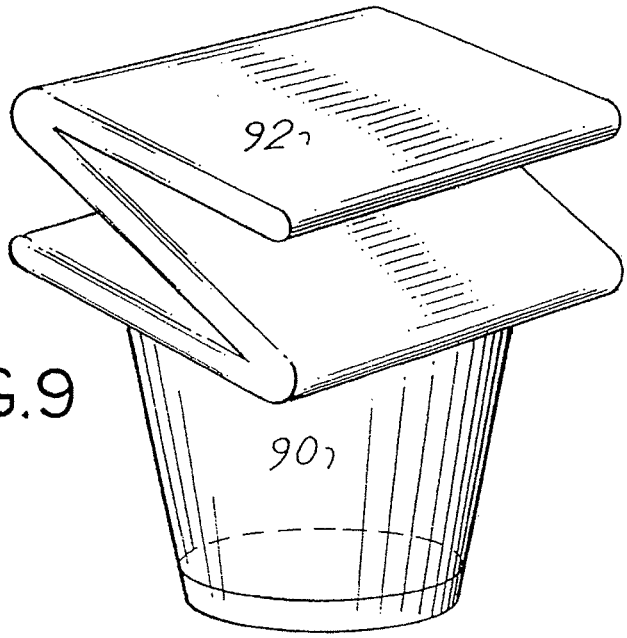
FIG. 9 is an isometric view of illustrating the embodiment of FIG. 8.
Figure 10:
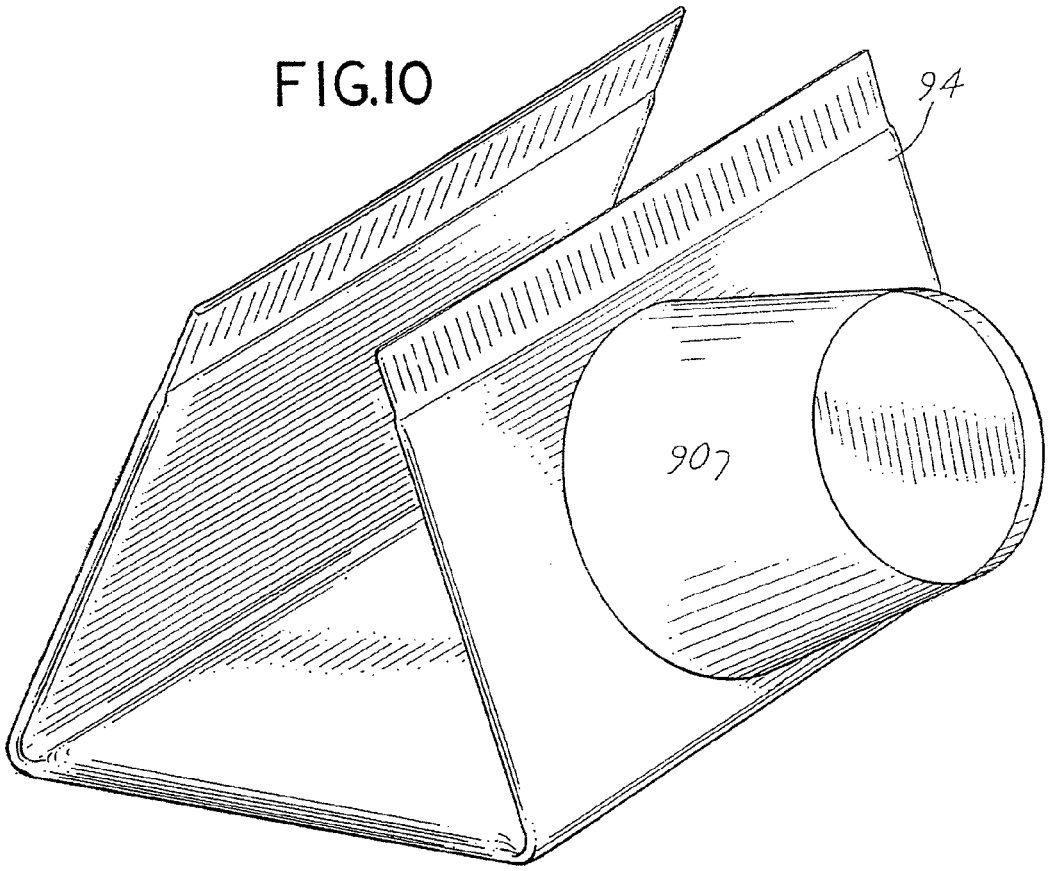
FIG. 10 is an isometric view illustrating an alternative embodiment of the invention.

FIGS. 8-10 depict an embodiment of the invention wherein a cup section 90 is combined with an expandable bag section 92. The bag section 92 is typically folded as shown in FIG. 9 prior to popping of a microwave corn product within the bag 92. The cup 90 or base 90 may be open to the package 92 as depicted in FIGS. 8 and 9. Alternatively, it may be merely attached to a portion or flap 94 of the package as depicted in FIG. 10. Thus, in the embodiment of FIG. 10, a standard microwave style microwave popcorn bag will have the additional feature of a cup member or cup base 90 attached thereto.

Figure 11:
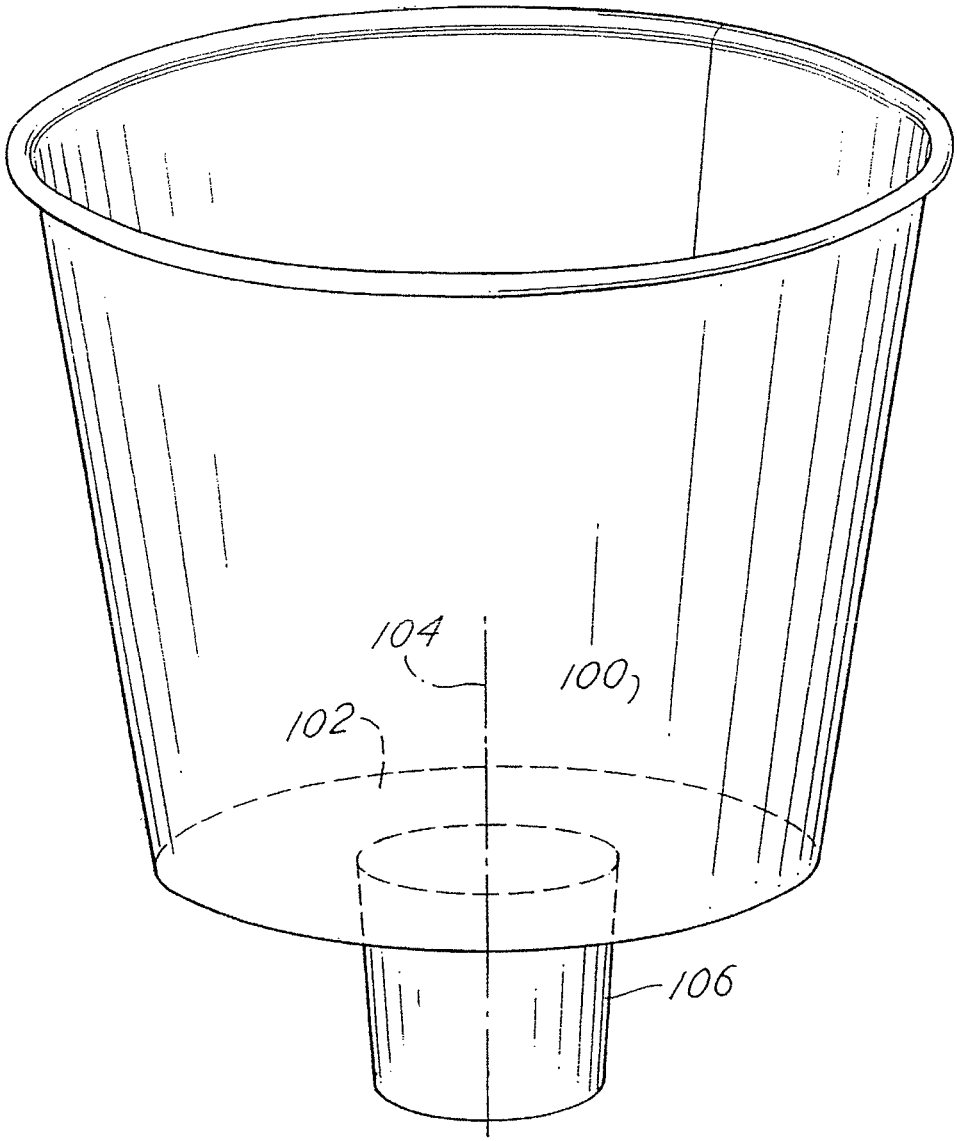
FIG. 11 is an isometric view of yet a further embodiment of the invention utilizing a paper or cardboard material.
Figure 12:
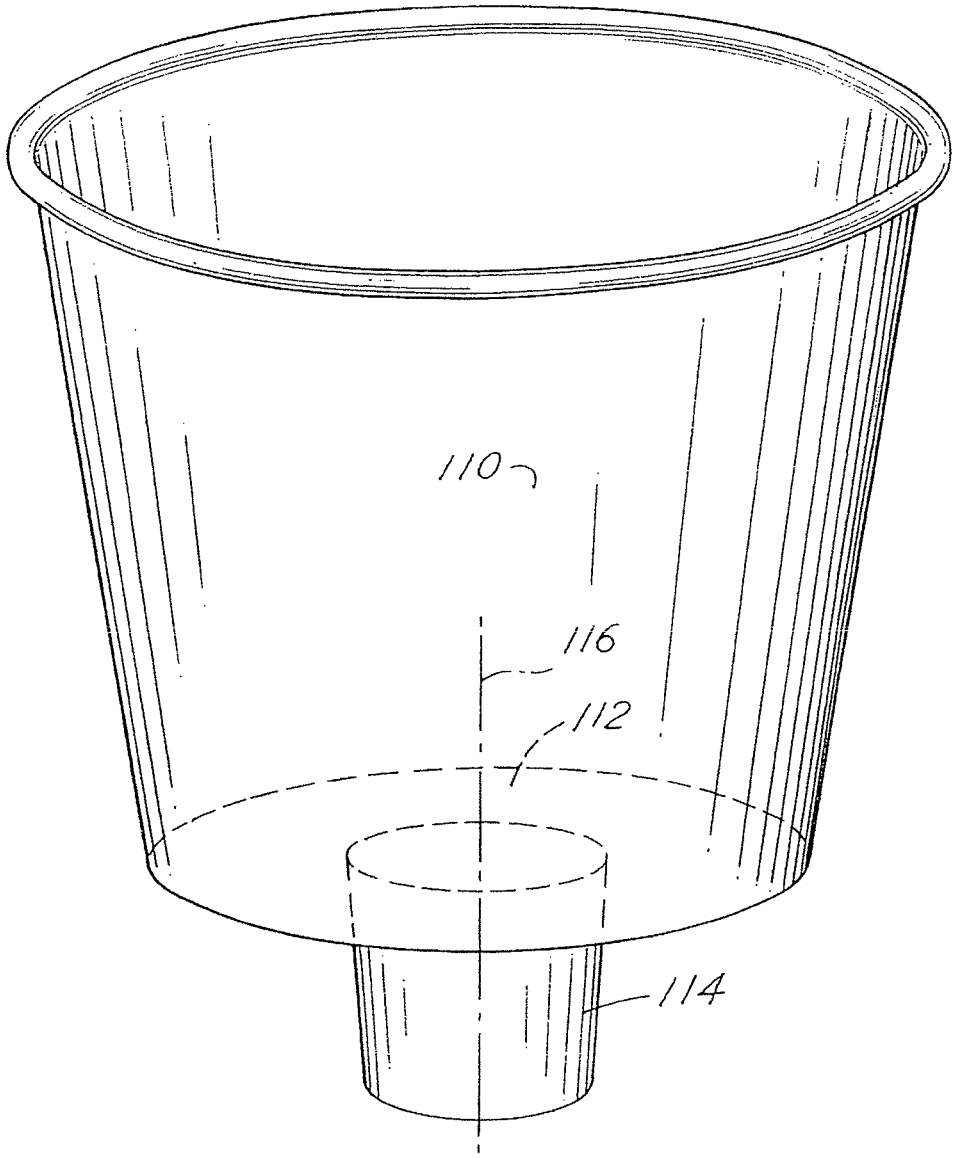
FIG. 12 is another embodiment of the invention similar to the embodiment to FIG. 11 wherein the product is manufactured from a molded plastic material.

FIGS. 11 and 12 set forth an embodiment of the invention which incorporates a large standard-sized tub or container for popcorn or other snack foods in combination with a standard-sized cup which is attached to the underside or bottom side of the container. FIG. 11 is a version wherein the component parts are manufactured from wax coated cardboard paper. FIG. 12 is directed to an embodiment of the invention wherein the item is a molded plastic item.

Thus, referring to FIG. 11, a tub or container 100 has a generally cylindrical shape and includes a formed bottom surface 102. The tub or container 100 has a centerline axis or axis of rotation or cylindrical axis 104. Attached to the underside or bottom panel 102 of the container 100 is a standard-sized cup or lower portion of a cup 106. Attachment may be effected by adhesive for example. The centerline axis 104 of the cup 106 is aligned with the axis 104 so that the container will have symmetry and be less likely to spill or fall from a cup holder. It is to be noted, however, that the lower cup portion 106 may be positioned at various other parts of the lower or underside panel 102 to provide desired positioning of the container. Additionally, more than a single cup element 106 may be attached to the underside panel 102 of the container in the event that the cup holder associated with the motor vehicle, movie theater seat or the like includes more than one cup holder receptacle arrayed next to each other, or for positioning the container off center with respect to the cup holder.

In FIG. 12, a container or tub 110 includes a molded plastic base or bottom panel 112 and has attached thereto or molded therewith a lower cup-sized base section 114. Again, in the preferred embodiment the axis or centerline axis 116 of the tub or container 110 is aligned with the centerline axis of cup section 114.

Figure 13:
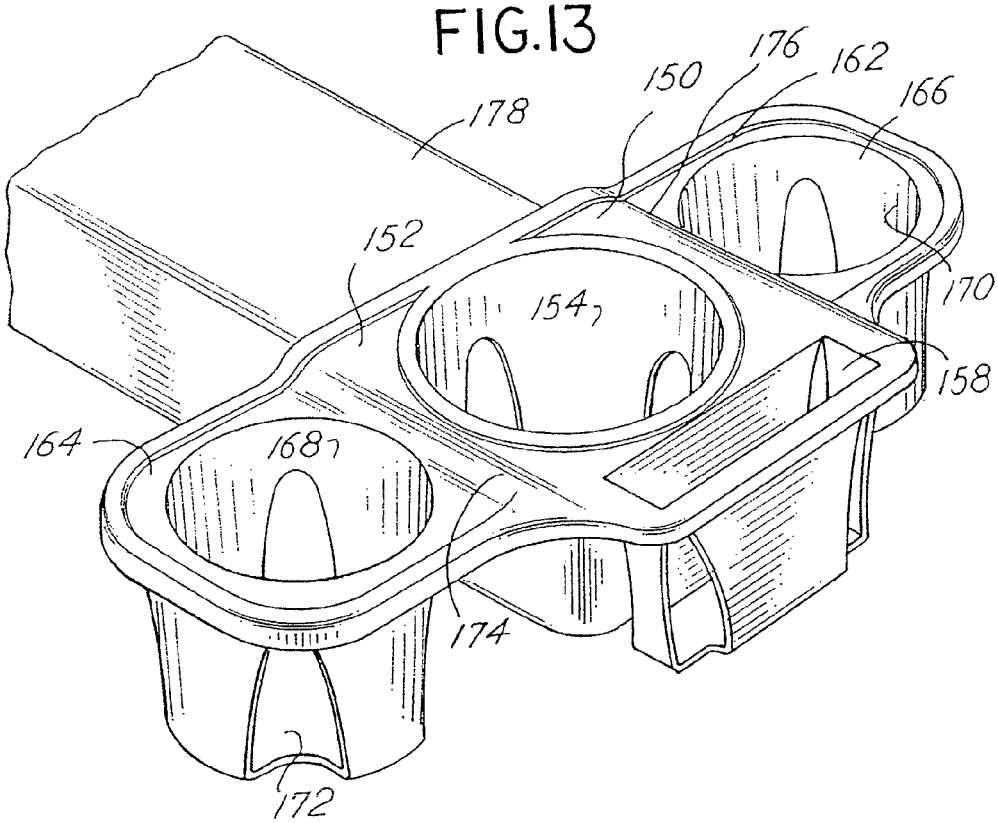
FIG. 13 is an isometric view of an alternative embodiment of the product tray and cup holder illustrated in position in a an arm of a theater seat.
Figure 14:
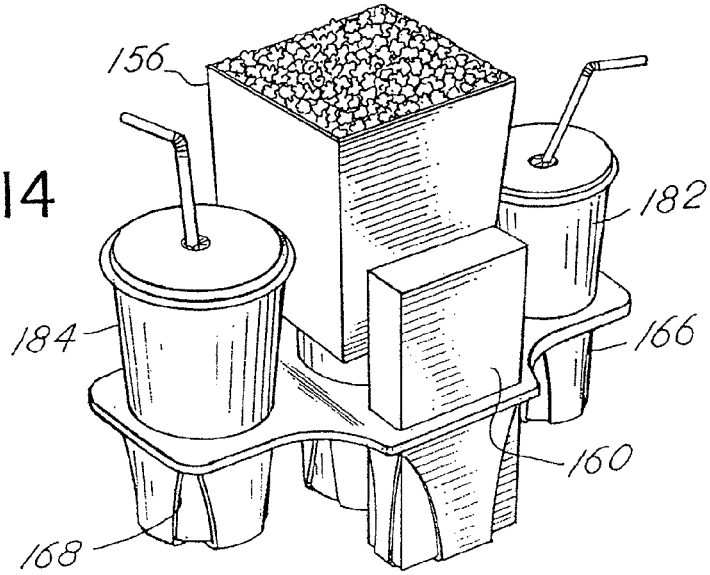
FIG. 14 is an isometric view of the tray of FIG. 13 illustrating the manner of placement of product of snack foods and drinks in the tray of FIG. 13.

FIGS. 13 and 14 illustrate a further embodiment of the invention. In this embodiment a molded or formed tray 150 includes a central web 152 with a generally cylindrical, central opening 154 for receipt, for example, of a cup or a generally congruent or compatible snack food holding item such as the popcorn box 156 in FIG. 14. The central web 152 further includes a recess opening 158 for snack foods such as a candy bar 160 as depicted in FIG. 14. Projecting from the center web 152 laterally is a first wing 162. Projecting in the opposite direction is a second wing 164. The wings 162 and 164 include respectively a molded passage or opening 166 and 168. The openings 166 and 168 include a generally cylindrical side wall, such as side wall 170, and a bottom surface such as the bottom surface 1'72. The projecting lateral side wings 164 and 162 are maintained in the lower elevation relative to the web 152. That is, there is a transition section such as the transition section 174. The transition section 174 in combination with the second transition section 176 forms a groove which accommodates that arm 178 of a theatre seat for example. This enhances the maintenance of the position of the food tray construction depicted in FIG. 13.

Thus as illustrated in FIG. 14 drink containers, such as containers 182 and 184, can be placed in the respective cup holders 166 and 168. The identified groove in the center of the tray assembly in combination with the depending sections 174 and 176 will tend to hold the tray in a fixed position on the arm 178 even when a filled cup 182 is removed from one side of the tray. In other words, the tray is designed to maintain balance even when items are removed therefrom. Further, the various cylindrical openings 166, 168 and 154 enable placement of various types of food containers therein. Also, the configuration of various openings or passages in the tray assembly may be configured in any desired shape although the center 154 preferably generally cylindrical with a draft. That is, the side walls of the cylindrical passage are inclined inwardly in a slight manner to facilitate holding the containers that are placed therein and to conform in general to the shape of those containers. Such a draft construction is utilized with respect to any of the openings provided in the tray as described as a preferred feature of the inventions.

Figure 15:
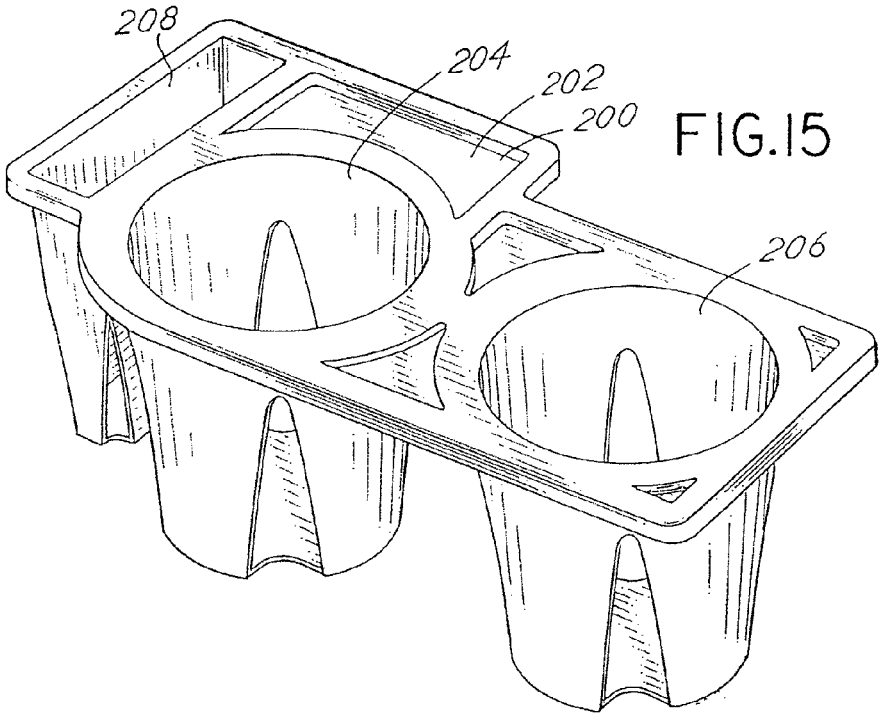
FIG. 15 is another alternative embodiment of the invention in an isometric view.
Figure 16:
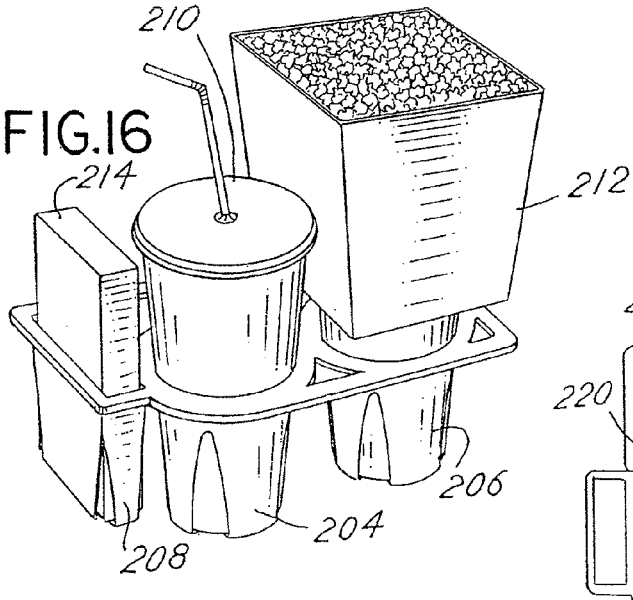
FIG. 16 is an isometric view of the embodiment of FIG. 15 having a snack food products positioned in the tray of FIG. 15.
Figure 17:
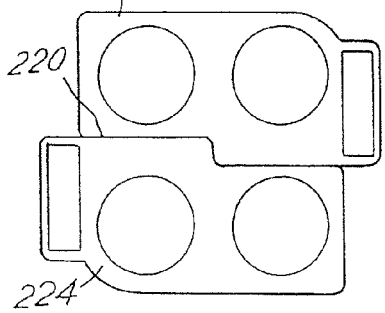
FIG. 17 is a top plan view of the embodiment of FIG. 15 illustrating the manner in which the product may be manufactured and configured.

FIGS. 15, 16 and 17 illustrate a further embodiment of the invention. In this embodiment which is fabricated from a molded plastic or wax covered paper material, the configuration of the tray 200 is such that a web 202 includes a first generally cylindrical drink or cup containing section 204, and the second similarly shaped section 206 with a rectangular opening to a rectangular parallelepiped section 208. Thus, a drink container or cup 210 may be positioned in the opening 204. A snack container 212 in the opening 206 and a package for candy, for example, package 214 in the opening 208. The center section 204 would preferably be placed in a cup holder and arm rest by way of example although it is possible to position the cup shaped section 206 in such an arm holder.

FIG. 17 illustrates the manner in which the embedment of FIG. 15 can be manufactured in a molding process wherein two such embodiments are molded with a tear line 220 separating the separate embodiments. The tear line 220 may be a perforated line or connection between the embodiments 222 and 224. Thus, the embodiments may be utilized for serving as well as any cup holder and snack holder for use in association with a theatre seat, for example. That is, if one is entertaining the configuration of FIG. 17 may be used to facilitate service of drink items and other snacks.

FIGS. 18-20 illustrate yet a further embodiment of the invention. A web 240 includes a cup section 242, a second cup section 244 and a snack or box receiving section 246. As shown in FIG. 19, the cup section 242 may receive a cup 243. A second section 244 may receive a food container such as a popcorn container 245 and the third section 246 may receive a box of snacks, box 247. The orientation of the various elements is such that the container 242 will serve to be placed in an arm rest of a seat, whereas the section 246 may fit over front arm of the seat and the section 244 will extend laterally from the seat. FIG. 20 illustrates the manner in which two such embodiments of the type shown in FIG. 18 may be physically molded or made with a separation line 260. In the tray represented by FIG. 20 may be used as a serving tray when entertaining or may be used as described to provide for placement in a cup holder to hold snack items.

Referring to FIG. 18, the bottom of the cup container 242 may include a downwardly projecting peg or extension 270 which will fit into passage 272 normally provided in cup holders in theatre seat arms 274. The peg or projection 270 from the bottom surface of the cup holder 242 thus fits within the opening 272 to facilitate maintenance of balance and placement of the tray. This concept may be employed in any of the embodiments heretofore described.

Again, referring to FIG. 18, depressions or depending molded forms 241 may be incorporated in the web 240 to hold the tray a fixed distance from an arm or cup holder and to facilitate balance as well as reinforce the tray. One or more formed depressions 241 may be molded or formed.

Figure 21:
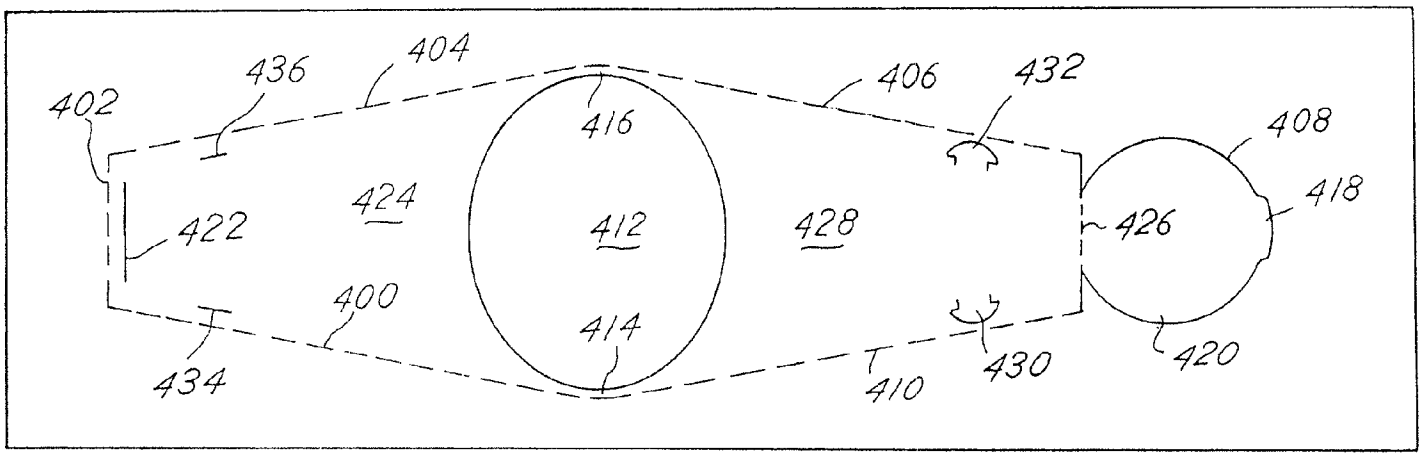
FIG. 21 is a plan view of another embodiment depicting the pattern for the embodiment.
Figure 22:
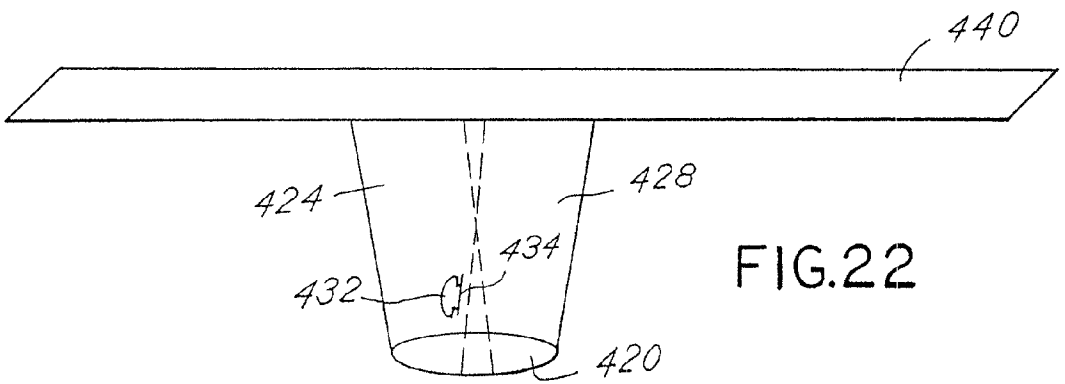
FIG. 22 is an isometric view of the embodiment formed from the pattern of FIG. 21.
Figure 23:
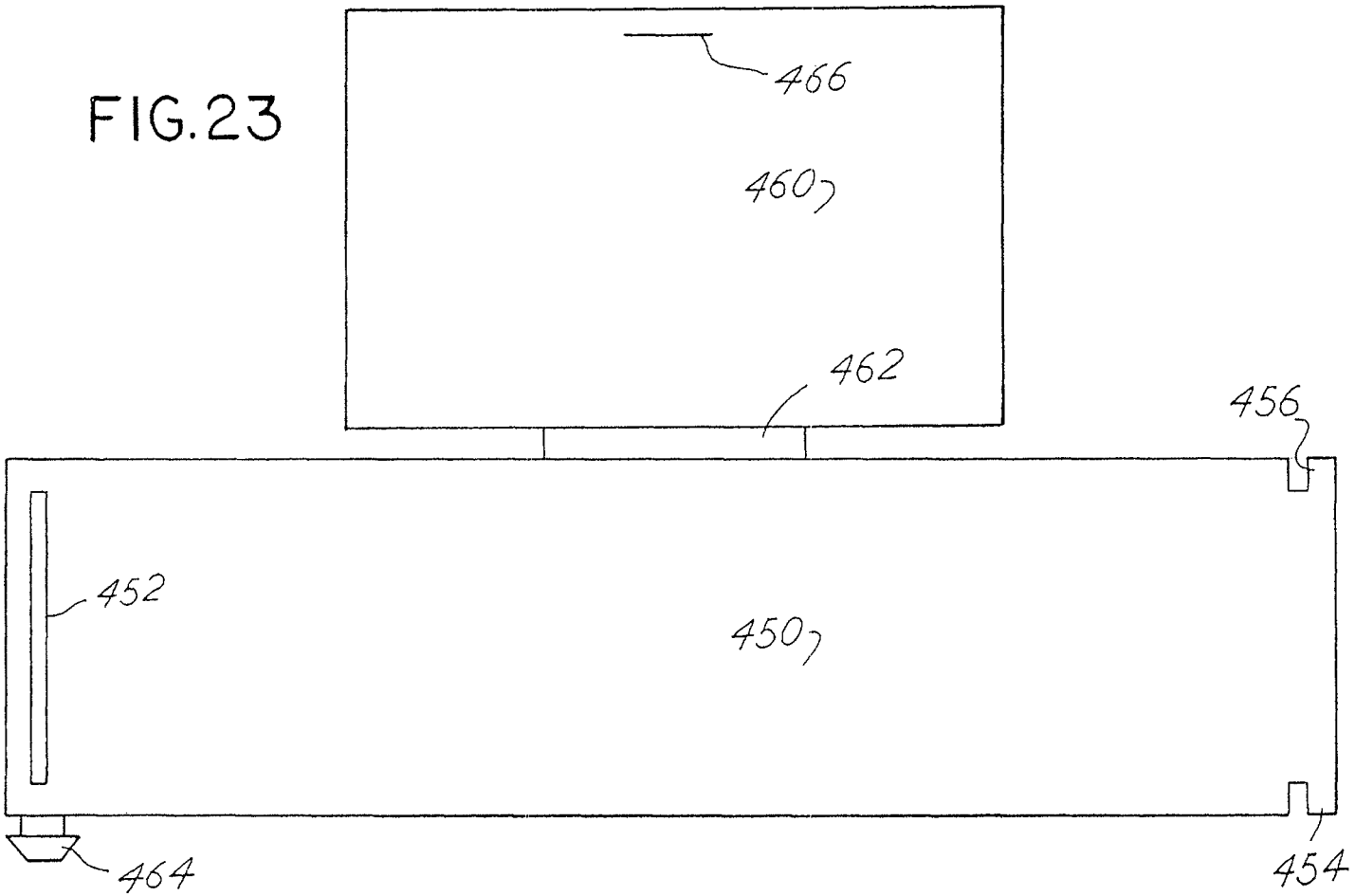
FIG. 23 is a plan view of another embodiment depicting a pattern for the embodiment.

FIGS. 21-22 and FIGS. 23-24 depict a variation or embodiment that provides a generally planar tray supported by a cup shaped lower section wherein the embodiments are formed from a flat sheet of die cut material such as cardboard stock. Referring to FIGS. 21-22 the flat stock in the form of a rectangular sheet is die cut along dotted lines 400, 402, 404, 406, 408 and 410. The center section 412 of the stock is also cut having a flexible hinge section 414, 416 on each side thereof. Tabs 418 are provided on a bottom side 420 to engage slot 422 cut in flap or semi-cylindrical section. The bottom side 420 is attached along a fold 426 to flap or semi-cylindrical section 428. Tabs 430, 432 at the edges of semi-cylindrical section 428 engage slots 434, 436 respectively when the flaps 424, 428 are folded as shown in FIG. 23 to form a truncated cup shape with a bottom side 420 supporting a flat planar tray 440. Thus, the formed cup will fit into a cup holder and the tray 440 will support snacks, etc.

Figure 24:
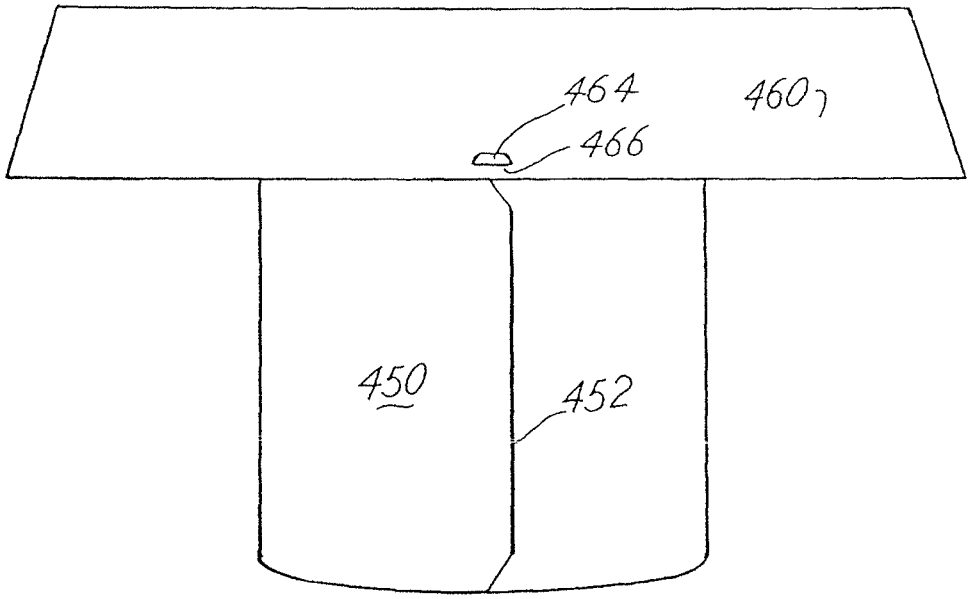
FIG. 24 is an elevation of the assembled embodiment of FIG. 23.

FIGS. 23-24 illustrate a variation or alternative to the embodiment of FIGS. 21-22. In FIGS. 23-24 flat stock is die cut with an elongate rectangular or nearly rectangular lower section 450 having a slot 452 for receipt of end tabs 454, 456 when section 450 is folded or formed as a' cylinder. An upper rectangular tray section 460 is attached by a side hinge element or connection 462 to a side edge of section 450. A locking tab 464 formed on the opposite side of section 450 may be fitted through a slot 466 in the side of upper tray section 460 to complete the folding of the die cut flat stock to the form of FIG. 24 where the lower section 450 will fit into a cup holder and the upper section 460 forms a tray.

FIGS. 25-36 illustrate a further embodiment of the invention wherein the product holder or container incorporates a generally rectangular parallelepiped upper section 500 and a generally cylindrical or frustoconically or truncated shaped lower section 502 in FIG. 25. The shaped lower section 502 fits into a compatibly sized opening or passage 504 in the arm 506 of a theatre chair 507. The embodiment is made from the single flat sheet of stock material such as paper or cardboard cut in the pattern illustrated in FIG. 28. Then, as illustrated in FIGS. 26-34, upon folding, the container is formed. As shown in FIG. 26, the rectangular parallelepiped holder or container may be filled with pop corn, for example. The pop corn will fill not only the rectangular parallelepiped holder 500, but also the generally cylindrical lower portion 502. Because the entire assembly is made from flat stock material cut from a single sheet and then folded, the holder will be adequately rugged though made from lighter weight stock. This is particularly true with respect to the lower cylindrical cup shaped portion 502 which has a generally frustoconical configuration as depicted in FIG. 27.

Figure 28:
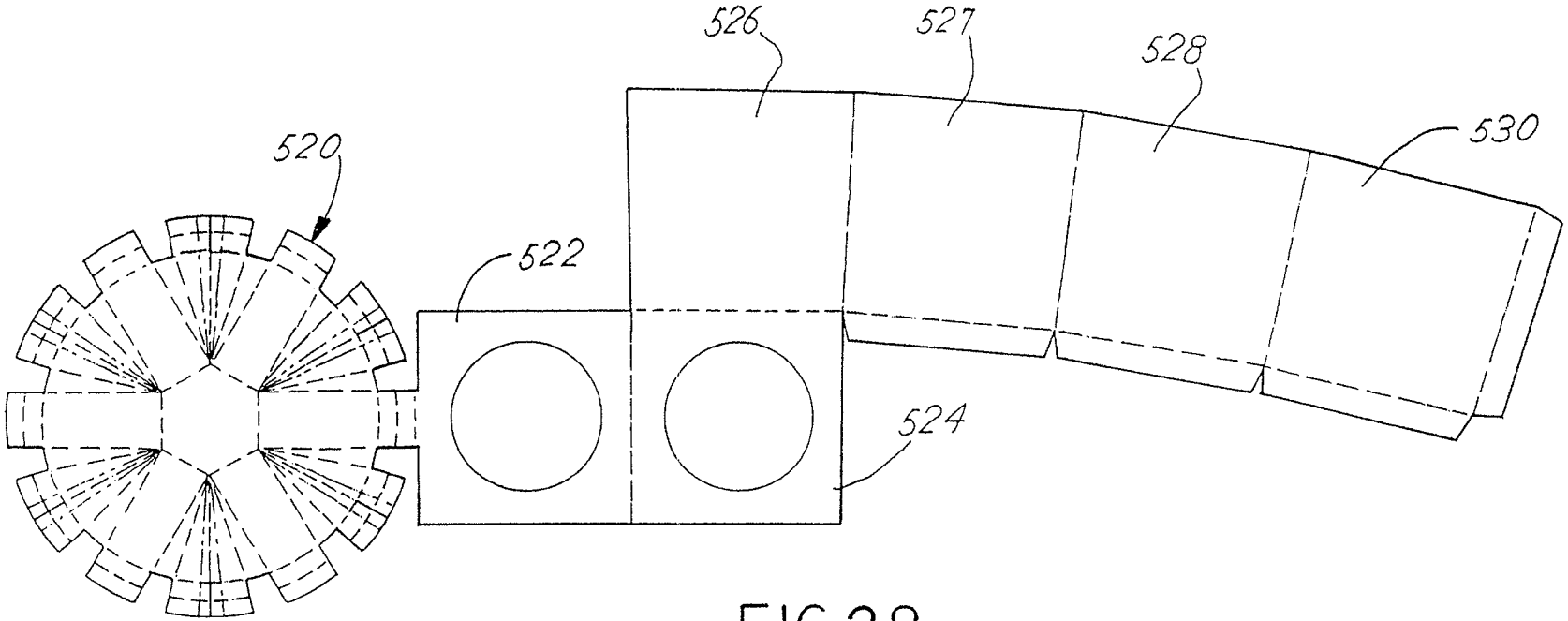
FIG. 28 is a plan view of the pattern for a sheet of paper or cardboard used to manufacture the embodiment of FIG. 25.

Thus, referring to FIG. 28, the pattern includes a generally circular section 520 which is scribed on fold lines to form the generally frustoconical or cylindrical lower section 502 of the carrier. This section 502 is attached to a first generally square bottom side section or panel 522 and a congruent second bottom side section 524. The remainder sections comprise rectangular side panels 526, 527, 528 and 530 which together are folded along scribe lines to form a generally parallelepiped configuration.

Figures 29, 30, 31, 32:
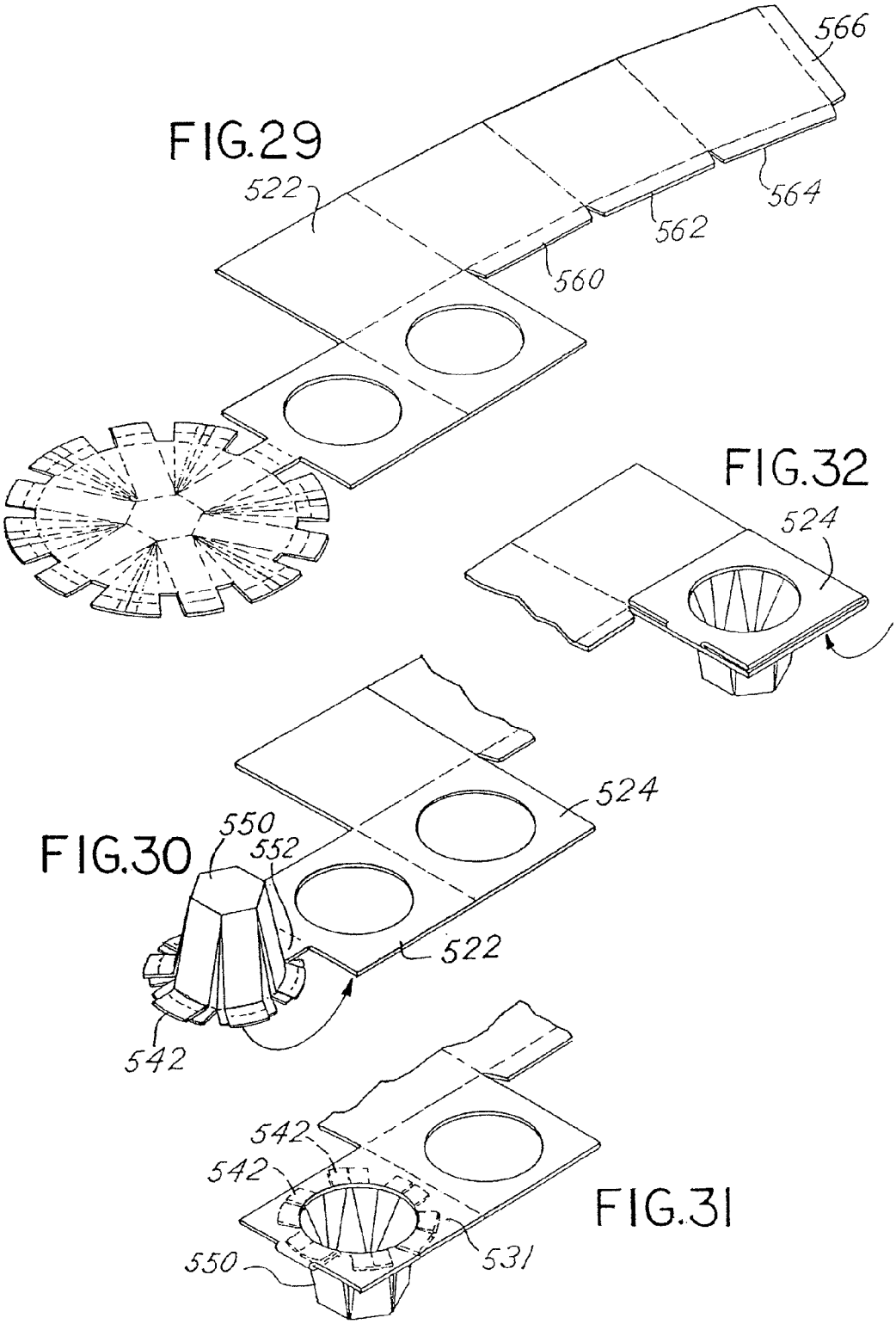
FIG. 29 is an isometric view of the pattern of FIG. 28.
FIG. 30 is an isometric view of the manner of folding the pattern of FIG. 29.
FIG. 31 is an isometric view illustrating a further step in the folding of the pattern of FIG. 29.
FIG. 32 is a further isometric view of a further step in the folding of the pattern of FIG. 29.

FIG. 29 is an isometric view of the pattern of FIG. 28. FIGS. 35 and 36 illustrate the manner of folding of the generally circular section 520. Thus, referring to FIGS. 35 and 36, the various fold or scribe lines are depicted which form the side elements of section 502 such as a side element 540 having an upper tab, such as a tab 542. FIG. 36 depicts the manner in which the side section 540 is folded with respect to the adjacent side sections 544 and 546. These elements are first folded to form the lower cup shaped section 502 such as depicted in FIG. 34. A first step in the formation of the product carrier, the circular section 520 is folded in accord with the teachings of FIGS. 35 and 36. This folding operation results in the cup as depicted as cup 550 in FIG. 31. The cup 550 is attached by a tab 552 to the generally rectangular bottom section 522. The bottom section 522 is then folded over the cup section 550 as shown in FIG. 30 and the tabs 547 are folded over the top surface of section 522 as shown in FIG. 31. The tabs 542 may be glued to the surface 531. The second bottom section 524 may then be folded over the first bottom section 522 to retain tabs 542.

Referring to FIG. 30 the cup section 520 is folded to the underside of the first bottom section 522. The second bottom section 524 is then folded over the first bottom section 522. Note that the tabs, such as the tabs 542, are positioned intermediate the bottom sections 522 and 524 and are retained. Thereafter, the side sections 526, 527, 528 and 530 are folded to form the rectangular shape of the upper section 502. The side tabs, such as tabs 560, 562 and 564 along the bottom edge of each panel 527, 528 and 530 are fitted between the first and second bottom sections 522 and 524. The vertical end tab section 566 is then sealed against the side of the section 526 to form an enclosure. FIG. 33 illustrates this last fold and insertion. FIG. 34 then illustrates the final construction.

The sections forming the rectangular upper container section 500 may be varied in dimension to thereby provide containers having a distinct capacity. By varying the dimension of the bottom sections 522, 524 as well as the side sections 526, 527, 528 and 530, the capacity of the container 500 is capable of adjustment. Typically, the containers are preformed and shipped in assembled condition to a refreshment counter or stand. The containers are therefore capable of being nested for purposes of shipment.

As previously mentioned, any or all of the various designs may be manufactured as folded sheets or as molded plastic products and any one of the designs may include indicia, such as writing instructions, etc. on the outside of the container portion. Further, any or all of the embodiments may include coating on the interior side. Further, the base container may serve as a portion or part of the interior of the combination cup shaped base and container for storage of a portion of the snack food element. However, in some embodiments, the base is a separate element attached to a panel of a container in order to enable the container to be placed in a cup holder. The particular shape of the base may thus be varied also, e.g. downwardly, be pending prongs or legs may be used, for example. The containers may include a separate liner or a liner which compartmentalizes the container into multiple sections for different snacks. The container may also include an insert which will receive and hold a cup with the remainder of the container for the purpose of placement of a snack therein.

Thus, while there has been set forth a preferred embodiment of the invention, it is to be understood that the invention is limited only by the following claims and equivalents thereof.

What is claimed is:

1. A cup holder for holding three generally cylindrical cup shaped items supported on a seat arm, said holder comprising:

a tray including at least a web, a first, a second and a third aligned depending, laterally spaced, generally cylindrical cup shaped container sections, each said first, second and third section having an open top and supported by said web, said second container section comprising a center container section and said first and third container sections extending respectively laterally from said second container section in opposite directions, each container section having a similar cup shape and sized to receive and hold a cup, said second container section sized and configured to fit into an individual single cup opening in the arm of a seat to maintain the holder, whereby said container sections are each formed to receive and retain a generally cylindrical cup, said web intermediate said second container section and said first and third laterally spaced container sections comprising, respectively, a first transition section and a second transition section respectively between the second section and the first and third lateral container sections, said transition sections, in combination, forming a groove in said web to accommodate the arm of the seat.

2. The holder of claim 1 wherein the tray is comprised of a molded material.

3. The holder of claim 1 wherein at least one of the container sections has an inwardly inclined draft.

4. The holder of claim 1 further including a snack holder recess opening section in the web adjacent the second section.

5. The holder of claim 1 further including a snack holder recess section in the web adjacent at least one of said container sections.

* * * * *